US010130542B1

(12) United States Patent
Strawder

(10) Patent No.: US 10,130,542 B1
(45) Date of Patent: Nov. 20, 2018

(54) DEVICE FOR POSITIONING THE NECK OF A PERSON IN THE FLEXION AND EXTENSION POSITIONS

(76) Inventor: Glenn Gerald Strawder, Burtonsville, MD (US)

( * ) Notice: Subject to any disclaimer, the term of this patent is extended or adjusted under 35 U.S.C. 154(b) by 293 days.

(21) Appl. No.: 13/068,087

(22) Filed: May 2, 2011

Related U.S. Application Data

(60) Provisional application No. 61/403,595, filed on Sep. 17, 2010.

(51) Int. Cl.
*A47B 7/00* (2006.01)
*A61G 13/12* (2006.01)

(52) U.S. Cl.
CPC ..... *A61G 13/121* (2013.01); *A61G 13/12* (2013.01)

(58) Field of Classification Search
CPC .... A47G 9/1081; A47G 9/109; A47G 9/1009; A61B 5/0555; A61B 6/0407; A61B 6/04; A61B 6/0421; A61G 13/121; A61G 2210/50; A61G 13/12; A61G 13/1255; A61G 7/072; A61G 13/04
USPC ..... 5/601, 636, 637, 640, 507.1, 661, 621, 5/622
See application file for complete search history.

(56) References Cited

U.S. PATENT DOCUMENTS

| | | | | |
|---|---|---|---|---|
| 3,302,021 | A | 1/1967 | Hardy | |
| 3,897,777 | A | 8/1975 | Morrison | |
| 4,045,678 | A * | 8/1977 | Rickard | 378/174 |
| 4,400,820 | A | 8/1983 | O'Dell et al. | |
| 4,463,758 | A | 8/1984 | Patil et al. | |
| 4,616,814 | A * | 10/1986 | Harwood-Nash et al. | 5/601 |
| 4,989,849 | A * | 2/1991 | Zupancic et al. | 5/622 |
| 5,233,713 | A * | 8/1993 | Murphy et al. | 5/636 |
| 5,491,736 | A | 2/1996 | Shudy | |
| 5,807,255 | A * | 9/1998 | Yokota et al. | 600/415 |
| 6,138,302 | A * | 10/2000 | Sashin et al. | 5/600 |
| 6,584,630 | B1 * | 7/2003 | Dinkler | 5/622 |
| 6,718,582 | B1 * | 4/2004 | Tinsley | 5/640 |
| 6,813,788 | B2 * | 11/2004 | Dinkler et al. | 5/622 |
| 7,430,773 | B2 * | 10/2008 | Brown et al. | 5/601 |
| 8,001,970 | B2 * | 8/2011 | King et al. | 128/845 |
| 8,732,879 | B2 * | 5/2014 | Patton et al. | 5/640 |
| 2002/0032927 | A1 * | 3/2002 | Dinkler | 5/601 |
| 2004/0055089 | A1 * | 3/2004 | Dinkler | A61B 6/04 5/622 |
| 2006/0150334 | A1 * | 7/2006 | Koch | 5/622 |
| 2007/0061972 | A1 * | 3/2007 | Brown et al. | 5/622 |
| 2014/0033437 | A1 * | 2/2014 | Gross et al. | 5/622 |

* cited by examiner

*Primary Examiner* — Richard G Davis
(74) *Attorney, Agent, or Firm* — Walter Ottesen, P.A.

(57) ABSTRACT

A device for supporting the upper body parts of a person next to the medical examining table where the rest of the body is resting and positioning the head and neck of the person above and below the top of the medical examining table for the taking of medical pictures.

16 Claims, 10 Drawing Sheets

DEVICE FOR POSITIONING THE NECK OF A PERSON IN THE FLEXION AND EXTENSION POSITIONS

RELATED CASES

I claim the benefit of my provisional application Ser. No. 61/278,968 filed Oct. 14, 2009, titled: Apparatus for Holding a Human Head or Face during a CT Scan Procedure.

I also claim the benefit of my provisional application Ser. No. 61/403,595 filed Sep. 17, 2010, titled: Apparatus for positioning and immobilizing the head, face or neck of a person having an X-Ray, CAT scan or MRI procedure.

BACKGROUND OF THE INVENTION

The need to examine the injured or non-injured neck of a person in the well known "flexion and extension positions" during the taking of conventional x-ray is critical when looking for ligament damage, subluxation and fractures of the neck. At a matter of fact, these two positions are vital in accurately investigating these abnormalities.

For decades now the flexion and extension positions of a neck have only been performed while a person is sitting or standing and from the side of the neck by only conventional x-rays (not CAT scan, MRI scan, etc.).

Traumatized neck injured patients are not allowed to sit or stand until an extensive examination is performed of the neck and clear of injury and the person is free of pain. The possibility of ligamentous injury causing instability in the absence of fractures of the vertebrae can only be reliably excluded with the flexion position and extension lateral positions of the neck using conventional x-rays.

Since these two positions of the neck give physicians greatly needed information, it is vital that the capability of performing these positions when the person is resting supine on a medical examining table.

Although CAT scans, MRI scans and PET scans are able to view internal anatomy of a person from more angles and gather more information of all body parts over conventional x-rays, these modalities take their pictures with a person resting supine, not sitting or standing.

Positioning the neck of a person lying supine in the flexion position and extension position will prove to be extremely useful to physicians in investigating injuries and abnormalities during a CAT scan, MRI scan, PET scan as well as conventional x-rays.

Head, face and neck holding devices in X-ray, CAT scan and MRI scan are well known as set forth in the prior art patents such as: U.S. Pat. No. 4,400,820; U.S. Pat. No. 4,463,758; U.S. Pat. No. 4,616,814 and U.S. Pat. No. 5,491,736, U.S. Pat. No. 4,045,678; U.S. Pat. No. 3,897,777; U.S. Pat. No. 3,302,021. These prior art methods are out dated and unadaptable to the current technologies and needs of Medicine today and tomorrow!

SUMMARY OF THE INVENTION

The words "extension position" refers to a person lifting their chin upward and back, away from their chest and holding that position while a medical picture is taken of the neck.

The words "flexion position" refers to a person tucking their chin down toward their chest and holding that position while a medical picture is taken of the neck.

The words "gear train" refers to two or more gears or wheels arranged to rotate or turn an object.

The words "horizontal plane" refers to the top plane of a medical imaging examining table which is parallel to the floor that the table's legs are standing on.

The words "medical images" or "medical pictures" refers to the way the modalities of Medical Radiology such as X-ray, CAT scan, MRI scan, etc. show the internal anatomy of a human being.

The words "lower body parts" or "lower portion" refers to the feet, ankles or lower legs of a person.

The words "medical table" and "medical examining table" refers to any table (X-ray table, CAT scan table, MRI scan table, PET scan table, stretchers, hospital beds, examining table, etc.) that a person is resting on in medicine.

The words "movable sidewall" or "movable vertical sidewall" refers to any ridge form capable of being moved from the side of the invention's platform inward toward its center and able to be secured (locked) in a desired location.

The word "platform" refers to surface capable of supporting the upper portion or lower portion of a human body and that mates with a support unit.

The word "position" and "positioning" refers to the manipulation or tilting of a body part from one plane to another show a slightly different angle or part of a specific internal structure for taking a medical picture.

The words "tilting device" refer to an apparatus designed to turn or tilt one end of a platform in at least two different directions and hold the platform securely in a desired location.

The words "upper body parts" or "upper portion" refers to the head, face, neck or shoulders of a person.

The word "supine" refers to a person lying down on his or her back.

The word "trunk" refers to the chest, abdomen and pelvic area of a person.

Performing the flexion position and the extension position of the neck (cervical spine) for medical reasons in Radiology have for many decades now only been accomplished while the person is sitting or standing and using conventional x-rays. Medical pictures of the flexion position and extension position of the neck of a person demonstrates ligaments, interspinous and interlaminar distances, facet joints and intervertebral spaces, and fractures such as: Atlas Dens Interval, Jefferson's Fracture, Atlanto Axial Rotatory Fixation, Atlanto Axial Subluxation, Transverse Ligaments, etc.

The flexion position of the neck requires a person to tuck their chin down toward their chest and hold that position. It is very difficult to impossible for a person (non-injured or injured) that is resting supine on their back to tuck his or her chin down toward their chest and hold that position.

The extension position of the neck requires a person to left their chin upward and back, away from their chest and hold that position. It is very difficult to impossible for a person (non-injured or injured) that is resting supine on their back to lift their chin up and away from his or her chest and hold that position.

This is why both the flexion position and the extension position of the neck (cervical spine) have not been successfully performed when a person is resting supine on a medical examining table and the back of his or her head is also resting on the table.

The flexion position of the neck as seen in FIG. 12 is used to position the base of the skull of a human head perpendicular with the beam of an x-ray tube to reduce the amount of radiation exposure the person's eyes receive during a CT scan of the head procedure. The actual degree of flexion needed depends on the position of the skull of a person while resting supine on a CT scanner table as seen in FIG. 11.

Although CAT scan, MRI scan and PET scan are able to show more detailed internal anatomy information then conventional x-rays, these methods do not take medical pictures while a person is resting supine.

It is the intent of the present invention to support the upper or lower parts of a human body adjacent to a medical examining table during the taking of medical images.

It is the intent of the present invention to provide the ability to position a person's neck in the flexion position or the extension position for the taking of a CAT scan, MRI scan, PET scan as well as conventional x-rays when the person is supine.

The size, shape and position of internal structures can vary dramatically from one person to another and still be within normal limits therefore, in it a further intent of the present invention to provide the ability to rotate a person's head and face from one plane, any desirable degree to visualize the internal structures of these body parts during a CAT scan, MRI scan, PET scan as well as conventional x-rays produce. Each degree these body parts are rotated or tilted shows a different angle or part of each internal structure. This will give physicians the ability to view selected internal structure such as part of the brain, an artery or vein, etc. from many different useful side or angles. These new and more useful angles will produce useful medical information about these internal structures.

It is also a further intent in some forms of the present invention to provide movable sidewalls for eliminating motion of the body part resting on the platform of the invention during the taking of a CAT scan, MRI scan, PET scan as well as conventional x-rays.

When using the present invention to re-examine the neck of a person in the flexion position and the extension position at intervals and over a period of time, the medical imaging information collected at each interval will help physicians better understand how to treat the limitations and progression of the neck. And, after studying this kind of medical information on a group of people (of various ages with various injuries and abnormalities), physicians will better determine the best way to successfully treat future patients with these injuries and abnormalities.

The present invention in its broadest form comprises a platform, a support unit, a connecting element and a tilting device or apparatus. The platform has two ends, one end is open and the other end mates with the support unit. The support unit has two ends, one end mates with the platform and the other end mates with a connecting unit. The connecting element has two ends, one end mates with the support unit and the other end attach or mates to a medical examining table. The tilting device or apparatus is attached to the platform. In some forms, the tilting device uses a ratchet to tilt the platform above or below the top of the medical examining table and to hold part of the platform in a desired position.

The present invention may employ any tilting device method (manual or motorized) capable of turning, tilting or elevating the platform in at least two different directions and able to secure the platform in a desired position.

The invention's tilting device methods may employ: 1) a single ratchet, 2) a reversible or socket ratchet, 3) a gear train, 4) two or more ratchets, etc. to tilt and hold the platform in a desired position.

In one form of the present invention, part or all of the platform has a concave configuration that mates with the back side of a human head or neck. The concave configuration adds support and security in holding the body part in a desired position during the taking of medical pictures.

In another form, the invention has a pair of movable vertical sidewalls capable of being moved from the side of the platform inward toward its center. Any known method of movable vertical sidewalls may be used. Movable vertical sidewalls may vary in size, shape and configuration. Movable vertical sidewalls may be attachable, detachable or permanently connected to the platform. Movable vertical sidewalls may use any know method to relocate and lock into a desired location.

There may be a pad or cushion that rest on the top surface of the platform as well as on the inner side of a movable sidewall to soften or cushion the body part.

For the invention to be used in most medical picture taking environments such as: X-ray, CAT scan, MRI scan and PET scan, the device must be composed of a different material. For example, the invention can be metal when the device is being used in conventional x-rays however, most metals can not be used during a CAT scan, MRI scan or PET scan.

DETAIL DESCRIPTION OF THE DRAWINGS

Figure 1:
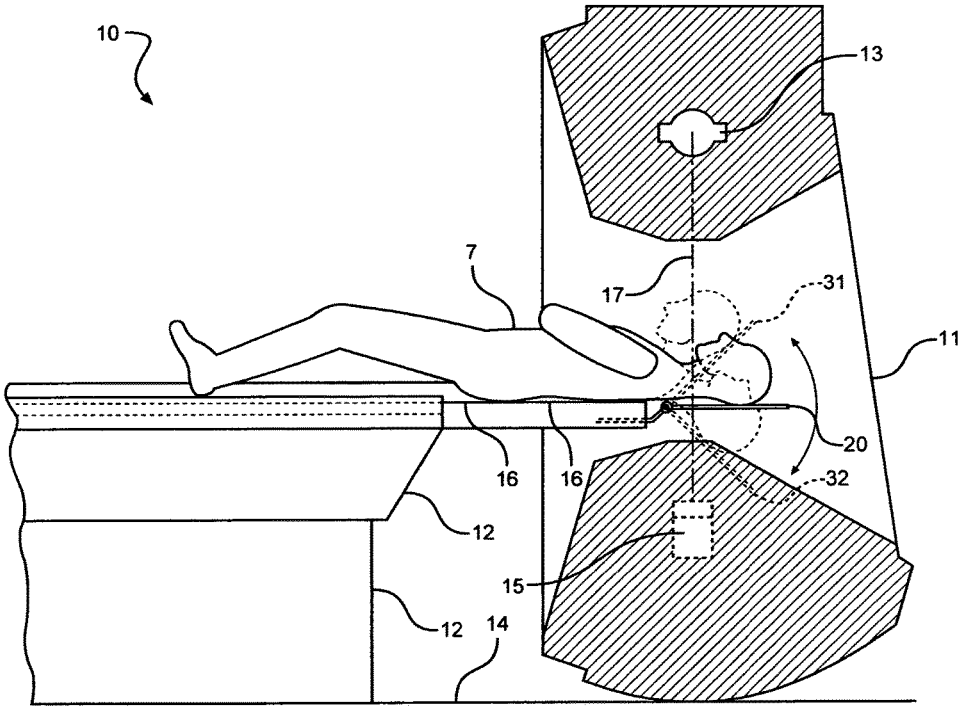
FIG. 1, is a side view of a CAT scanner with a person supine on its table. The present invention is attached to the end of the CAT scanner's table and shown supporting the head and neck of a person in the horizontal (neutral position), upward tilt (flexion position) and the downward tilt (extension position).

FIG. 1 shows a side view of a CAT scanner 10. The CAT scanner 10 has a medical examining table 12 that stands on floor 14. Person 7 is resting supine on medical examining table 12. The floor 14 is level and in a horizontal plane. The top 16 of medical examining table 12 is level and in a horizontal plane parallel to floor 14. The gantry 11 is where pictures are taken has an x-ray tube 13 and detectors 15 to receive x-ray beam 17. The top 16 of medical examining table 12 travels through the gantry 11 opening to take medical imaging pictures.

FIG. 1 illustrates the present invention attached to medical examining table 12 and supporting the upper portions of person 7 to make a picture of these body parts.

FIG. 1 shows the platform 20 of the invention supporting the upper body parts of person 7 in a horizontal plane or neutral position (similar to FIG. 12) parallel to the top 16 of table 12 to make a picture of these body parts.

FIG. 1 also shows a shadow image 31 of platform 20 in the upward tilt position (flexion position of the neck) supporting the upper body parts of person 7 to make a picture of these body parts.

FIG. 1 also shows a shadow image 32 of platform 20 in the downward tilt position (extension position of the neck) supporting the upper body parts of person 7 to make a picture of these body parts.

Figure 2:
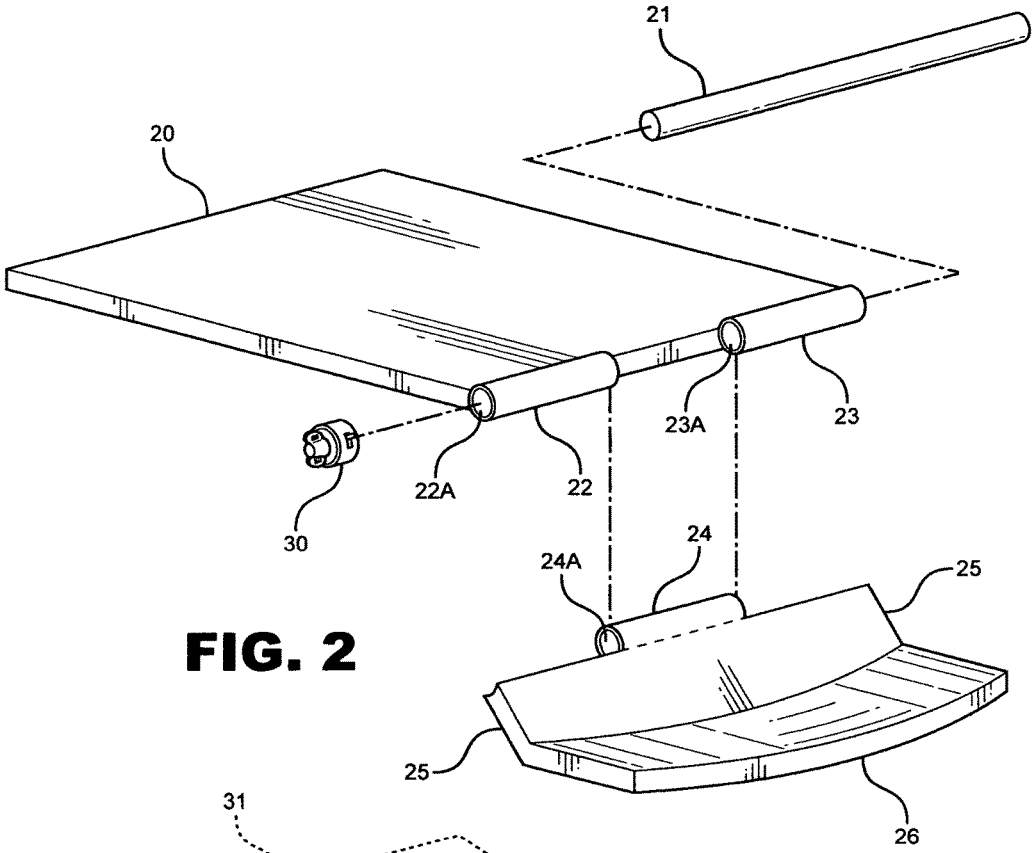
FIG. 2, is an exploded perspective view of the preferred embodiment of the present invention.

FIG. 2 shows the present invention disassembled into parts consisting of a platform 20, a rod 21, a support unit 25, a connecting element 26 and tilting device 30.

Still, referring to FIG. 2, platform 20 has two ends. One end of platform 20 is open while near the other end there are two horizontally placed sleeves (sleeve 22 and sleeve 23 respectively). The invention can employ any number of sleeves and the sleeves may have any form or shape.

Sleeve 22 is open at both ends. Opening 22A on the left side of sleeve 22 is shown in FIG. 2 while the opening on the right side is not.

Sleeve 23 (similar to sleeve 22) is open at both ends. Opening 23A on the left side of sleeve 23 is shown in FIG. 2 while the opening on the right side is not.

Opening 22A of sleeve 22 and opening 23A of sleeve 23 are aligned with each other.

Opening 22A of sleeve 22 and opening 23A of sleeve 23 are slightly smaller then the opening 24A in sleeve 24 of support unit 25. Rod 21 fits inside the openings of sleeve 22 and sleeve 23 and sleeve 24 to mate or attach platform 20 to support unit 25. Rod 21 is large enough in diameter to fit tightly inside the opening 22A of sleeve 22 and opening 23A of sleeve 23 but small enough to fit loosely inside the opening 24A of sleeve 24 so that when rod 21 is turned platform 20 will tilt with its rotation. Sleeve 22, sleeve 23, sleeve 24 and rod 21 together form a hinge joint type method.

The invention may employ any method that mates one end of platform 20 with support unit 25 in a hinge joint type fashion that allows platform 20 to tilt in at least two different directions when turned. And, although not illustrated here for the sake of brevity, all of these methods are incorporated in the invention.

In FIG. 2 both sleeve 22 and sleeve 23 of platform 20 and sleeve 24 of support unit 25 and rod 21 are shown as separate parts however, in some forms of the invention these elements may be combined and although are not illustrated, these combinations are all incorporated in the present invention. For example, platform 20, sleeve 22, sleeve 23 and rod 21 may be combined in a one piece unit permanently attached near one end of platform 20.

Still referring to FIG. 2, support unit 25 has two ends. At one end of support unit 25 there is at least one sleeve 24. Sleeve 24 is horizontally positioned to mate with both sleeve 22 and sleeve 23 of platform 20 when the two ends are brought together. When sleeve 24 of support unit 25 is placed between sleeve 22 and sleeve 23 of platform 20, rod 21 can pass through the openings in all three sleeves and attaches platform 20 to support unit 25. Once rod 21 helps attach platform 20 to support unit 25 in a hinge joint type method as shown in FIG. 3, FIG. 5, FIG. 9 and FIG. 10.

Figure 12:
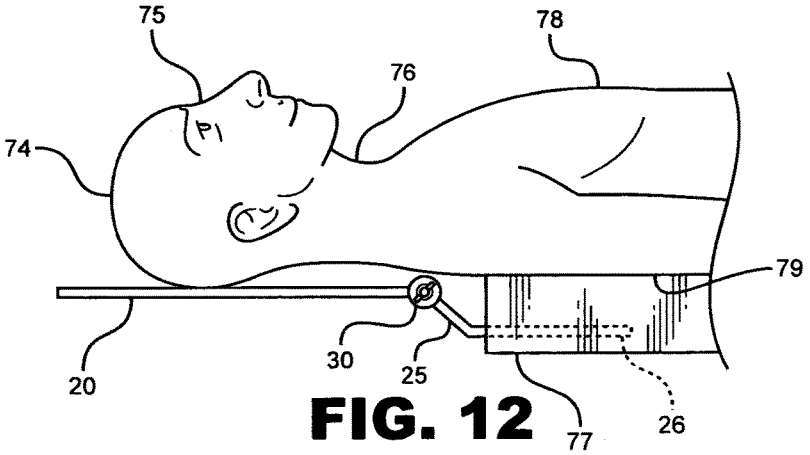
FIG. 12, shows the invention attachable to the end of a medical examining table supporting the upper portion of a person in the same horizontal plane as the top of the medical examining table.
Figure 13:
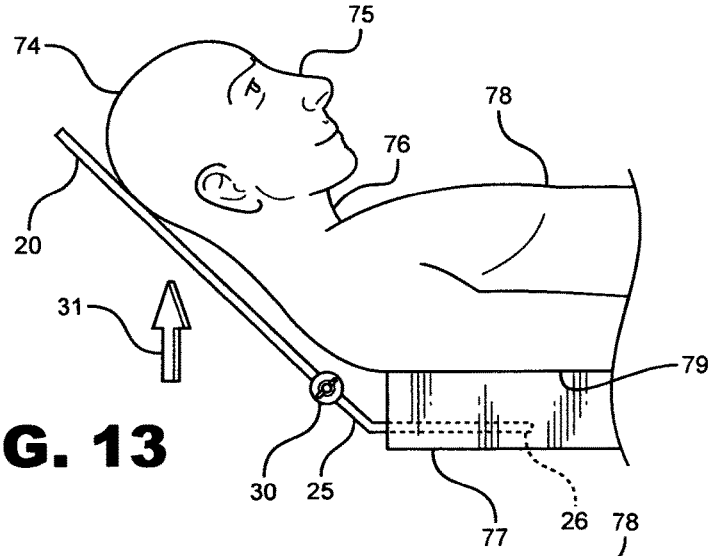
FIG. 13, shows the invention in FIG. 12 tilting the upper portions of the person upward, above the horizontal plane in FIG. 12.
Figure 14:
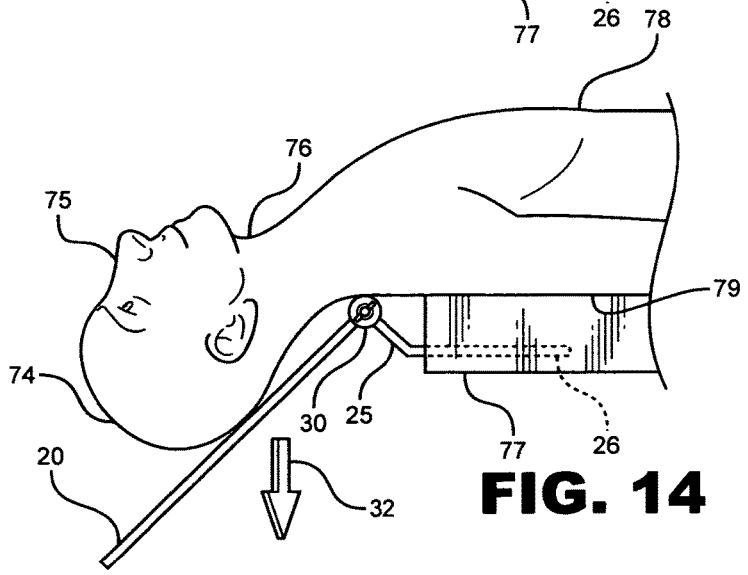
FIG. 14, shows the invention in FIG. 12 tilting the upper portions of the person downward, below the horizontal plane in FIG. 12.
Figure 15:
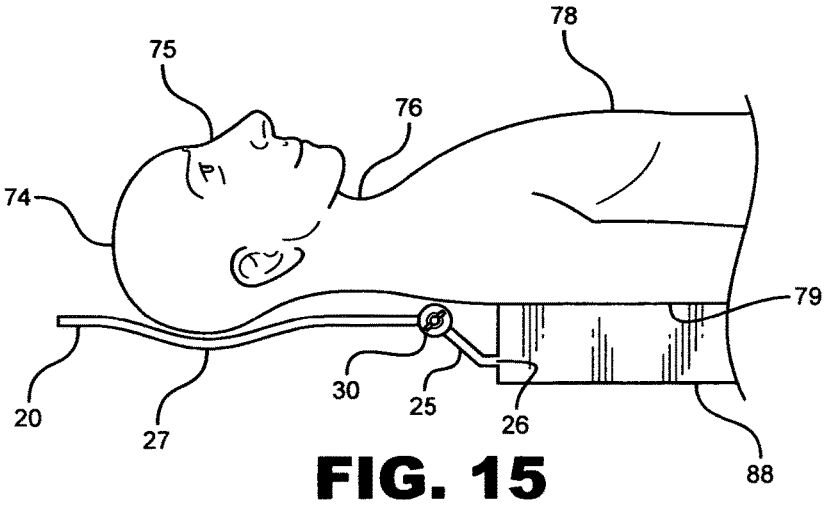
FIG. 15, shows the invention permanently attached to the end of a medical examining table with a concave shape platform supporting the back of the head of a person.
Figure 16:
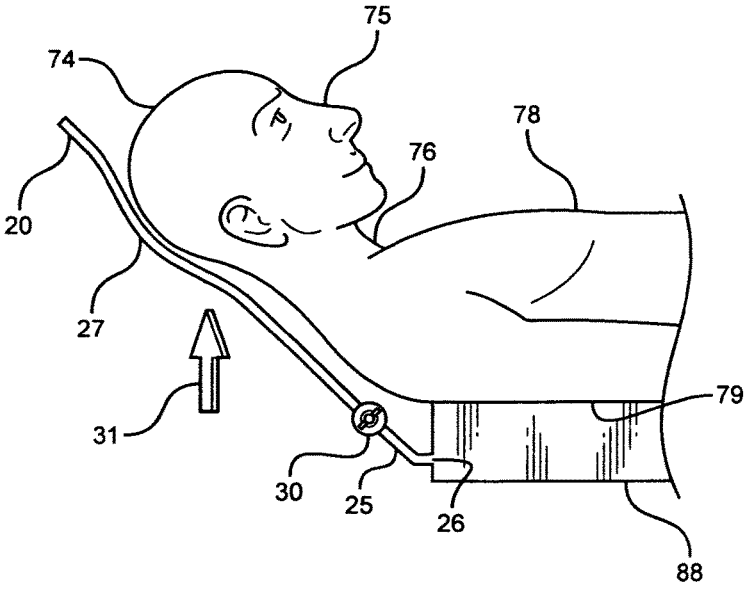
FIG. 16, shows the invention in FIG. 15 tilting the head and neck of the person upward, above the top of the medical examining table.

At the other end of support unit 25 (opposite the end with sleeve 24) is connecting element 26. Connecting element 26 is used to connect support unit 25 to a medical examining table. Connecting element 26 may employ any method capable of connecting support unit 25 to a medical examining table as shown in FIG. 3, FIG. 5, FIG. 12, FIG. 13, FIG. 14, FIG. 15 and FIG. 16. Connecting element 26 of support unit 25 may be attachable and detachable to medical examining table 88 as shown in FIG. 12, FIG. 13 and FIG. 14. Connecting element 26 of support unit 25 may be permanently attached to medical examining table 88 as shown in FIG. 15 and FIG. 16.

FIG. 2 shows a tilting device 30. Tilting device 30 gives an operator the ability to turn a thumbscrew to rotate platform 20 in one or more directions. Tilting device 30 may employ any method capable of tilting platform 20 in more than one direction and hold platform 20 in a desired position.

Figure 3:
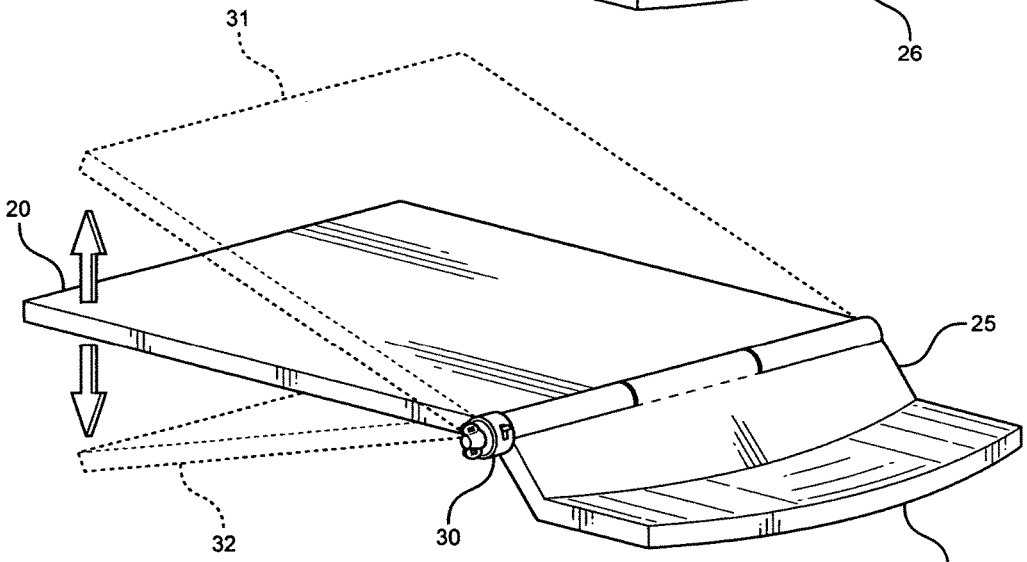
FIG. 3, shows the parts of the invention in FIG. 2 assembled and also two shadows of the platform indicating two directions that the platform tilts.

FIG. 3 is the embodiment of the invention in FIG. 2 assembled.

FIG. 3 shows tilting device 30 holding platform 20 in three different positions.

In FIG. 3, shadow image 31 (upward tilt) of platform 20 and shadow image 32 (downward tilt) of platform 20 indicates the directions and range that tilting device 30 can turn, elevate or tilt platform 20.

Figure 4A:
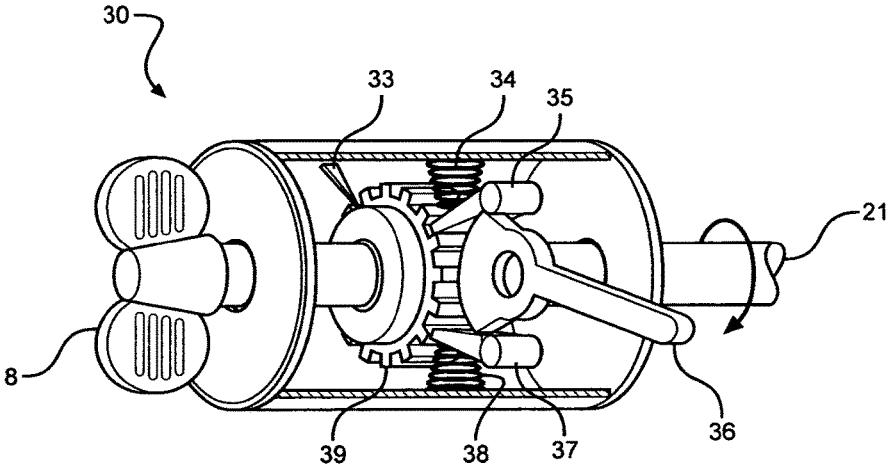
FIG. 4A, is an enlarged inside view of the motor device in FIG. 3 showing a reversible or socket ratchet inside set to rotate the rod in a clockwise direction.

FIG. 4A show an enlarged inside view of tilting device 30 in FIG. 2 and FIG. 3 employing a reversible or socket type ratchet method.

In FIG. 4A, titling device 30 has a lever 36 used by an operator to select the desired direction rod 21 will be rotated when thumbscrew 8 is turned clockwise or counterclockwise.

FIG. 4A shows lever 36 disengage with pawl 37 and capable of engaging with pawl 35. The force of spring 34 causes pawl 35 to engage with wheel or gear 39. When the operator turns thumbscrew 8 clockwise rod 21 will turn clockwise which will tilt platform 20 upward as seen in shadow image 31 of FIG. 2. Once the desired location of platform 20 is reached, the operator stops turning thumbscrew 8 and pawl 35 engages with the space between the teeth of wheel 39 to hold the desired position.

For safety reasons, a tooth 33 is positioned inside tilting device 30 to engage with the teeth of wheel or gear 39. Tooth 33 makes contact with gear 39 as it turns. The contact that tooth 33 makes each time it touches one of the teeth 33 on gear 39 as gear 39 rotates creates a sound. The sound that tooth 33 makes each time it touches one of the teeth 33 various with the speed that gear 39 is rotated and can be used as a safety warning indicator to the operator on how slow or fast (unsafe) he or she is tilting platform 20. There are many methods and ways to warn or notify the operator when he or she is tilting platform 20 that an unsafe speed has been reached and all of those methods and ways are incorporated in the invention.

Figure 4B:
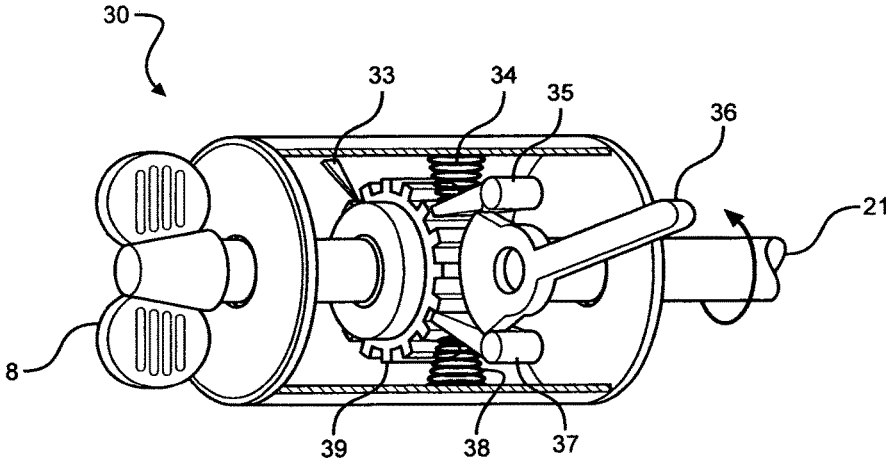
FIG. 4B, is an enlarged inside view of the motor device in FIG. 3 showing a reversible or socket ratchet inside set to rotate the rod in a counterclockwise direction.

FIG. 4B is an enlarged inside view of tilting device 30 in FIG. 2, FIG. 3 and FIG. 4A.

In FIG. 4B lever 36 is engaged to tilt platform 20 in the opposite direction of FIG. 4A.

FIG. 4B shows lever 36 disengage with pawl 35 and capable of engaging with pawl 35. The force of spring 38 causes pawl 37 to engage with wheel or gear 39. When the operator turns thumbscrew 8 counterclockwise rod 21 will turn clockwise which will tilt platform 20 downward as seen in shadow image 32 of FIG. 2. Once the desired location of platform 20 is reached, the operator stops turning thumbscrew 8 and pawl 37 engages with the space between the teeth of wheel or gear 39 to hold the desired position.

Figure 5:
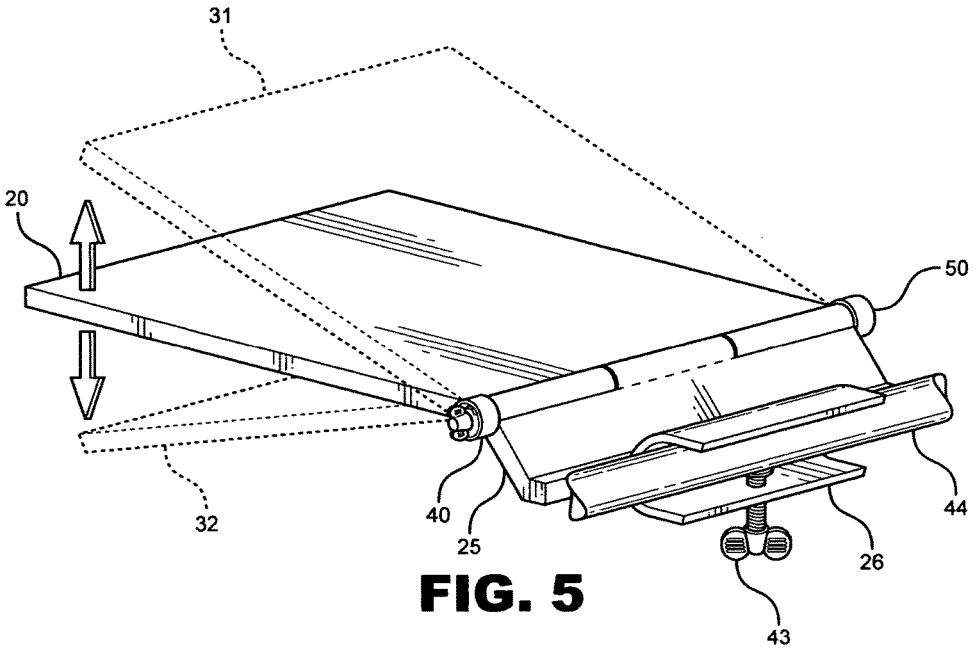
FIG. 5, shows the invention assembled with two motor devices, one on each side of the platform and a C-shape clamping connecting element connected to the frame of a medical examining table.

FIG. 5 shows a form of the invention employing two separate tilting devices (device 40 and device 50).

FIG. 5 shows platform shadow image 31 and platform shadow image 32 indicating the directions that platform 20 can be tilted by tilting device 40 and tilting device 50 respectively.

FIG. 5 also shows support unit 25 with a C-shape clamp connecting element 26. C-shape clamp connecting element 26 is placed over hospital bed frame 44 and an operator tightens thumbscrew 43 to secure (lock) platform 20 in place.

Figure 6:
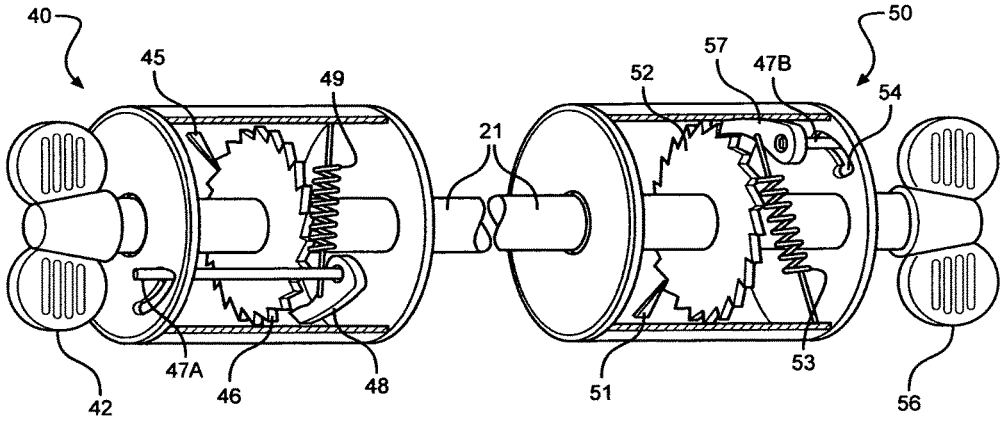
FIG. 6, is an enlarged inside view of the two motor devices in FIG. 5. Each device is identical in parts but set in the opposite or mirror image of the other device. One tilting device for turning the platform upward and the another device tilting for turning the platform downward.

FIG. 6 shows an enlarged inside view of tilting device 40 and tilting device 50 in FIG. 5 each employing a simple ratchet method.

In FIG. 6 tilting device 40 and tilting device 50 have identical ratchet parts however, these parts are assembled in the opposite way (mirror image) of each other. Tilting device 40 is placed on the left side of platform 20 and tilting device 50 is placed on the right side of platform 20.

According to FIG. 6, tilting device 40 is designed by the direction of wheel 46 teeth to tilt platform 20 in only one direction (upward 31) when pawl 48 is engaged and an operator turns thumbscrew 42 clockwise. However, pawl 48 is not engaged with wheel 46 in FIG. 6 and unable to rotate or turn rod 21. But, in FIG. 6 pawl 57 of tilting device 50 is engaged with wheel 52 and ready for an operator to turn thumbscrew 56 clockwise to tilt platform 20 in only one direction (downward 32).

Tilting device 40 has a thumbscrew 42 that when turned rotates rod 21 and wheel 46 to tilt platform 20. Tilting device 50 thumbscrew 56 when turned rotates rod 21 and wheel 52 to tilt platform 20.

Tilting device 40 and tilting device 50 both have a tooth 45 and tooth 51 respectively that make a sound when either comes in contact with wheel 46 and wheel 52 respectively as the operator turns thumbscrew 42 or thumbscrew 56 to alert the operator of the speed at which he or she is turning rod 21.

As seen in FIG. 6, pawl 48 of tilting device 40 is disengaged with wheel 46 preventing an operator from being able to turn thumbscrew 42 which rotates rod 21 and securing platform 20 in a desired location. Also seen in FIG. 6 is pawl 54 of tilting device 50 engaged with wheel 52 allowing an operator to turn thumbscrew 56 to rotate rod 21 and secure platform 20 in a desired location.

In FIG. 6 thumbscrew 42 of tilting device 40 turns rod 21 clockwise. And, in FIG. 7 thumbscrew 56 of tilting device 50 turns rod 21 counter-clockwise.

As shown in FIG. 6 tilting device 40 has a button or pin 47A positioned and disengaging pawl 48 from wheel 46, preventing tilting device 40 from controlling the direction platform 20 will be directed.

Also seen in FIG. 6 is tilting device 50 with button or pin 47B is positioned so that pawl 54 engages with wheel 52 which allows tilting device 50 to direct platform 20 downward 32.

Figure 7:
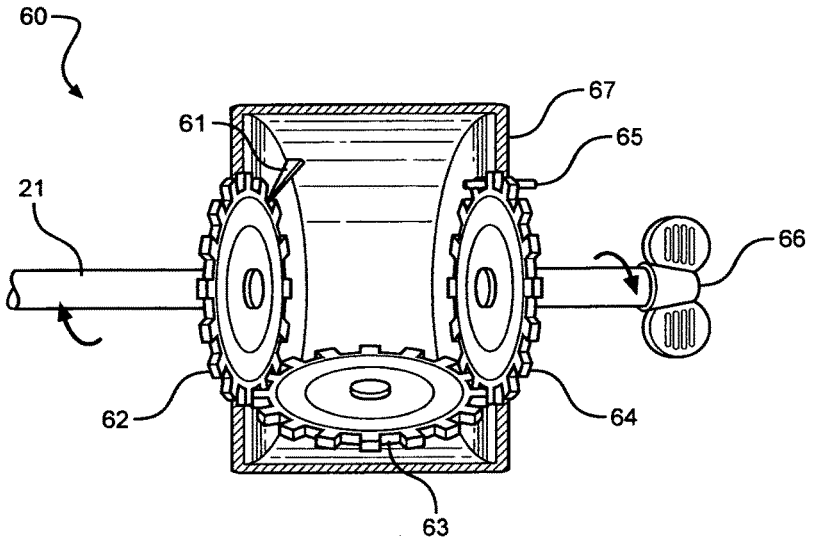
FIG. 7, is an enlarged inside view of a device employing a gear train method for tilting the platform upward and downward and holding a desired position.

FIG. 7 is an enlarged inside view of tilting device 60 employing a gear train method.

FIG. 7 shows an enlarge inside view of tilting device 60 gear train method for turning rod 21, tilting or elevating platform 20 and securing platform 20 in a desired location.

Any number and pattern of wheels of a gear train can be incorporation in the present invention.

FIG. 7 shows still another form of the invention's tilting device 60 employing a gear train method or a series of three wheels (wheel 62, wheel 63 and wheel 64) to rotate rod 21 and tilt platform 20. Pin 65 is inserted through an opening (not shown) in wall 67 of the housing unit to engage and rest between the teeth of gear wheel 64. When pin 65 is in place, thumbscrew 66 and rod 21 can not be turn in either direction. In this form of the invention, the operator removes pin 65 and turn thumbscrew 66 clockwise or counterclockwise to tilt platform 20 to a desired degree or tilt then replaces pin 65 to prevent platform 20 from moving from the desired location.

Figure 8:
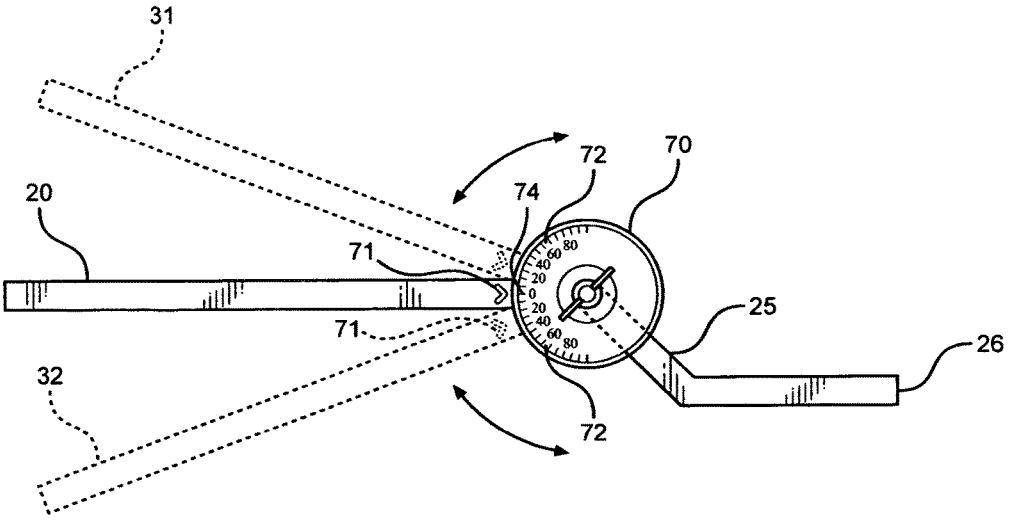
FIG. 8, is a side view of the invention with a meter to indicate how many degrees the platform is tilted above and below a particular horizontal plane.

FIG. 8 is a side view of the invention with an indicator 71 on platform 20. Indicator 71 is for helping the operator place platform 20 in a level horizontal plane of zero 74. There is also meter 70. Meter 70 may or may not be attached to platform 20. Meter 70 has a scale of numbers above and below zero 74. When zero 74 on meter 70 is aligned with indicator 71 on platform 20 a horizontal plane is established. Indicator 71 shows an operator the direction and degree in which he or she tilts platform 20 according to this alignment.

Monitoring and recording the positions of meter 70 for the flexion position (see FIG. 13) and extension position (see FIG. 14) during the taking of medical pictures of a person using the invention helps physicians see the exact amount of limitation a person has performing these positions. This will help physicians track the progress of treating a person and know early on if a treatment plan is working (successful).

Figure 9:
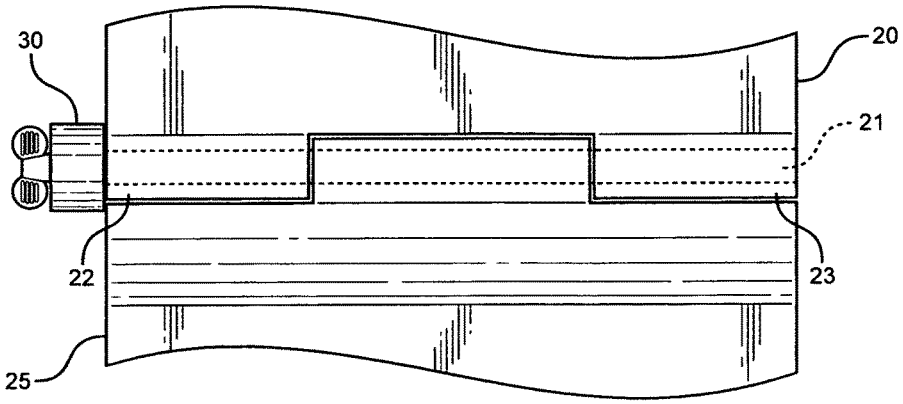
FIG. 9, is an enlarged view of one way the invention can be assembled.

FIG. 9 is an enlarged view showing part of platform 20, tilting device 30, rod 21 and part of support unit 25 assembled.

Figure 10:
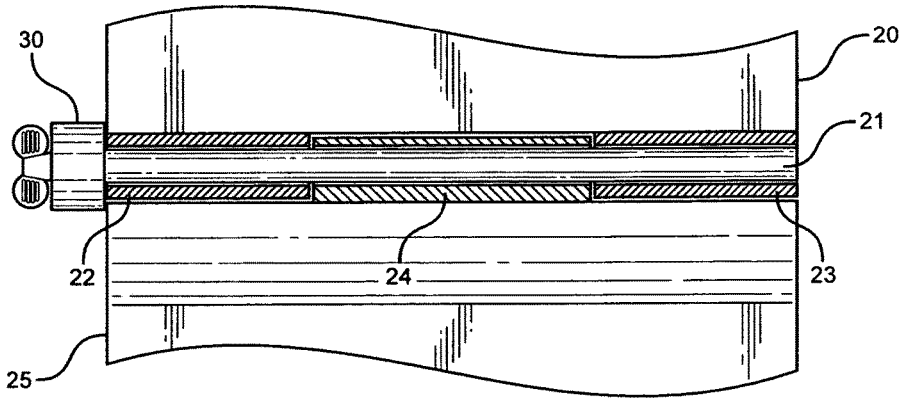
FIG. 10, is a cross-section of FIG. 9.

FIG. 10 is a cross sectional view of FIG. 9.

Figure 11:
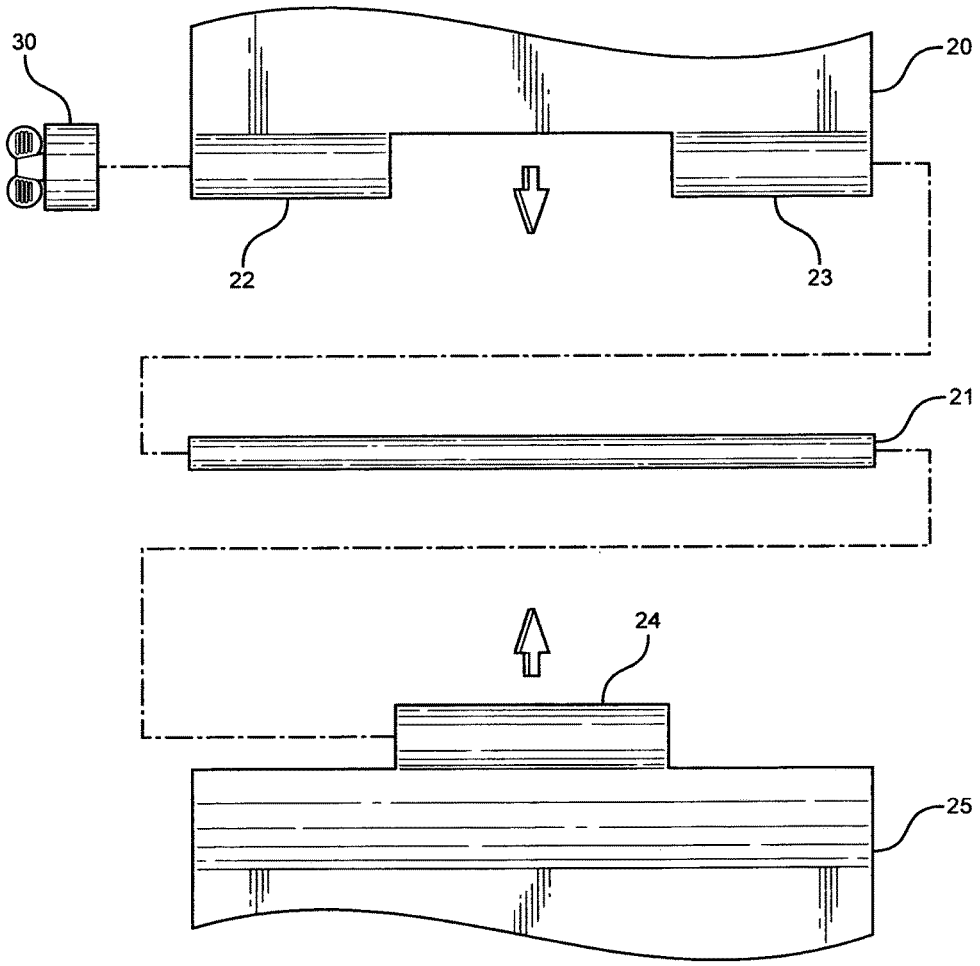
FIG. 11, shows the assembly FIG. 9 disassembled.

FIG. 11 shows the elements of FIG. 9 and FIG. 10 disassembled.

FIG. 12, FIG. 13 and FIG. 14 shows connecting element 26 of support unit 25 inserted in a slot (not shown) inside medical examining table 77.

In FIG. 12, FIG. 13 and FIG. 14 the invention is attachable and detachable to medical examining table 77.

FIG. 12 shows the head 74, face 75 and neck 76 of person 78 in a neutral position with platform 20 in a horizontal plane parallel to the top 79 of medical examining table 77.

FIG. 13 shows the head 74, face 75 and neck 76 of person 78 with platform 20 tilted upward 31 above the top 79 of medical examining table 77. Tilting the neck 76 of person 78 one degree or more up above the top 79 of medical examining table 77 produces the "flexion position of the neck". Every degree of tilt produces a new perspective, view, angle or part of the inside anatomy being tilted.

FIG. 14 shows the head 74, face 75 and neck 76 of person 78 with platform 20 titled downward 32 to the top of medical examining table 77. Tilting the neck 76 of person 78 one degree or more down below the top 79 of medical examining table 77 produces the "extension position of the neck".

In FIG. 12 platform 20 is held in a horizontal plane parallel to the top 79 of medical examining table 77. The back of head 74 and neck 76 rest on top of platform 20. The position of head 74, face 75 and neck 76 on platform 20 in Medical Radiology is known as the AP (anterior-posterior) or neutral position of these body parts during the taking of medical pictures.

FIG. 12 shows platform 20 in the same horizontal plane as the top 79 of medical examining table 77 and supporting the upper portion of person 78. Platform 20 is also capable of support the lower portion or feet, ankles and lower legs of person 78 (not illustrated) when person 78 is turned 180 degrees from the current position of person 78 supine on medical examining table 77.

In FIG. 13 platform 20 is tilted or elevated above a horizontal plane similar to the horizontal plane of the top 79 of medical examining table 77 or the neutral position of FIG. 12.

FIG. 13 shows head 74, face 75 and neck 76 of person 78 in the flexion position while the remaining body parts of person 78 are resting supine on medical examining table 77 during the taking of medical pictures.

FIG. 13 shows platform 20 tilted or elevated upward 31 and positioning head 74, face 75 or neck 76 of person 78 different then there positions in FIG. 12. FIG. 13 shows the invention positioning head 74, face 75 or neck 76 of person 78 above a horizontal plane parallel to the horizontal plane of the top 79 of medical examining table 77 in FIG. 12.

This invention's new range of turning, tilting and positioning the head 84, face 85 and neck 86 of person 78 above the top 79 of medical examining table 77 during medical pictures will be extremely useful to medicine.

In FIG. 14 platform 20 is supported and positioned below a horizontal plane similar to the horizontal plane of the top 6 of medical examining table 77.

FIG. 14 shows head 74, face 75 and neck 76 of person 78 in the extension position while the remaining body parts of person 78 are resting supine on medical examining table 77 during the taking of medical pictures.

FIG. 14 shows platform 20 tilted downward 32 positioning head 74, face 75 and neck 76 of person 78 different then there positions in FIG. 12 and FIG. 13. FIG. 14 shows the invention positioning head 74, face 75 or neck 76 of person 78 below a horizontal plane parallel to the top 79 of medical examining table 77 in FIG. 12.

The invention's new range of positioning the head 84, face 85 and neck 86 of person 78 below a horizontal plane similar to the horizontal plane of the top 79 of medical examining table 77 during medical pictures will be extremely useful to medicine.

FIG. 15 shows connecting element 26 of support unit 26 permanently attached to medical examining table 88.

FIG. 15 shows support unit 25 attached to platform 20 and supporting the upper portion of person 78 in a horizontal plane.

FIG. 15 shows platform 20 supporting head 74, face 75 and neck 76 of person 78 in a neutral position similar to FIG. 13.

FIG. 16 also shows platform 20 with a concave form 27 that mates with the back of head 74 or neck 76 of person 78. Concave form 27 adds more support in holding head 74 of person 78 in various degrees of the flexion position. Concave form 27 may employ any shape or form to mate with the back of head 74 or neck 76 of person 78.

FIG. 16 shows connecting element 26 of support unit 26 permanently attached to medical examining table 88.

FIG. 16 shows support unit 25 of the invention permanently attached to medical examining table 88.

FIG. 16 shows platform 20 tilted in the upward 31 above the horizontal plane of medical examining table 88 with concave body 27 supporting the back of head 74 of person 78 resting supine.

Figure 17:
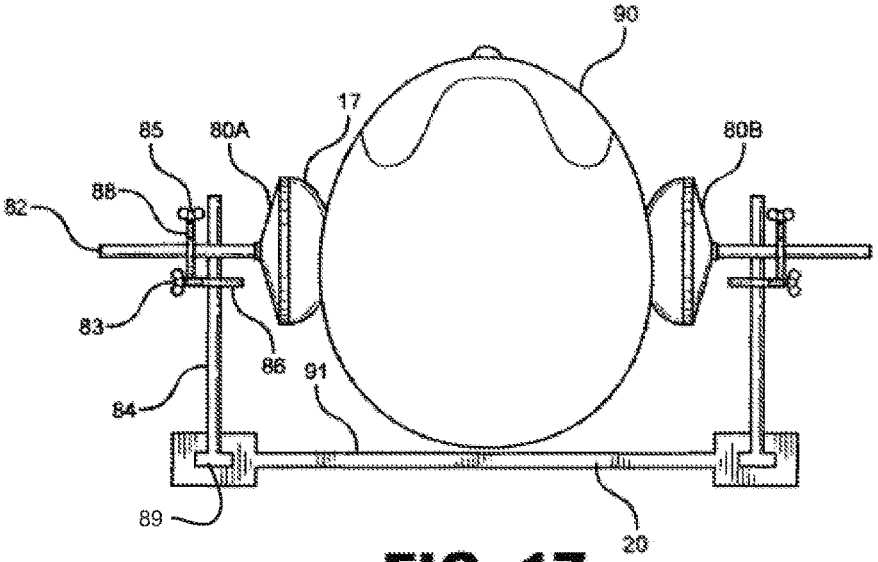
FIG. 17, shows a pair of movable sidewalls mating with slots and shows the invention supporting the head of an adult person with movable sidewalls holding the head in place.

FIG. 17 shows a pair of movable sidewalls. Movable sidewalls are not new and many types can be found in the prior art.

In FIG. 17, in some forms the invention employs a pair of movable sidewalls (movable sidewall 80A and movable sidewall 80B respectively). Movable sidewall 80A and movable sidewall 80B are used to reduce or eliminate voluntary and involuntary movement of the head, face or neck of a person during the taking of medical pictures. There any many, many ways to attach and relocate movable sidewalls to platform 20. For the sake of brevity, only one is shown here however, all may be incorporated in the invention.

In the form shown in FIG. 17 movable sidewall 80A and movable sidewall 70B both employ a right angle ring method to locate, adjust and secure these sidewalls. In FIG. 17 there is a horizontal ring 86 and a vertical ring 88. Vertical ring 88 may sit on an edge of horizontal ring 86. Horizontal ring 86 has a thumbscrew 83. There is a vertical pole 84 that has a base 81 that fits in slot 89 of platform 20. Base 81 of vertical pole 84 may use any method to mate with platform 20 and relocate to different locations. Vertical pole 84 fits inside horizontal ring 84.

The invention may incorporate any method that will allow movable sidewall 80A to mate with platform 20. The invention may incorporate any method that gives movable sidewall 80A the ability to be moved to different locations on platform 20.

When thumbscrew 83 is loosen, the operator can adjust the height of movable sidewall 80A by rising and lowering horizontal ring 86 up and down respectively pole 84 in reference to the top 91 of platform 20 until a desired location is found and then turns thumbscrew 83 to lock ring 86 in place which helps movable sidewall 80A remain at the current height. Vertical ring 88 has a thumbscrew 85. Horizontal pole 82 fits inside vertical ring 88. When thumbscrew 85 is loosen, the operator can adjust the location of movable sidewall 80A by pushing or pulling horizontal pole 82 in and out of vertical ring 88 until a desired location is found and then turning thumbscrew 83 to lock pole 82 in place which helps movable sidewall 80A remain at the current inward distance.

Movable sidewall 80A and movable sidewall 80B may employ a pad 17 to cushion their clamping force efforts when placed next to the side of adult head 90.

Figure 18:
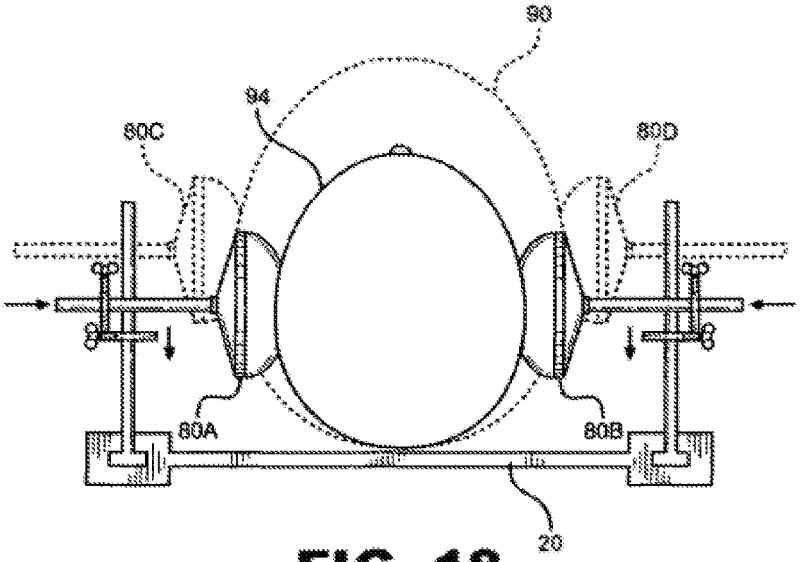
FIG. 18, shows how movable sidewalls adapt to supporting body parts of different shapes and sizes.

FIG. 18 shows how shadow movable sidewall 80C and shadow movable sidewall 80D can restrict adult head 90 from movings.

FIG. 18 shows how movable sidewall 88A and movable sidewall 88B in the illustrated sidewall form can adjust from holding adult head 90 to holding child head 94.

What is claimed is:

1. A method of supporting and positioning a head or neck of a human being in a flexion position or an extension position, comprising:

providing a platform that supports said head or neck;

providing at least a first and a second cylindrical platform sleeve connected at or near one end of said platform and comprising a hole at each end the first and the second platform sleeves;

providing a support that supports and is connected to said platform;

providing at least one cylindrical support sleeve connected at or near an end of the support, wherein the at least one cylindrical support sleeve comprises a hole through the at least one cylindrical support sleeve;

providing at least one rod, wherein the at least one rod fits inside and is positioned through the holes of the first and the second platform sleeves and the at least one cylindrical support sleeve thereby connecting said platform to said support, wherein:

said rod is straight and round and comprises two ends, all of said holes of said first and second cylindrical platform sleeves and said at least one cylindrical support sleeve are aligned with each other creating a single straight tunnel through all of said sleeves, said rod is positioned inside said tunnel, said rod is fixed and is not rotatable with respect to said first and second cylindrical platform sleeves such that rotation of said rod causes said platform to tilt, and said rod is not fixed and is rotatable with respect to said at least one cylindrical support sleeve, said rod and sleeves form a hinge that mates the platform and the support together, the at least one cylindrical support sleeve is positioned between the first and the second platform sleeves when the rod is positioned therethrough, and said hinge has an axis of rotation through which the platform moves in an upwards or downwards tilt;

providing a connection that fixedly holds said support and said platform adjacent to one end of a medical examining table; and providing a tilting mechanism comprising a ratchet mechanism that is connected to one of said two ends of the rod, wherein said at least one rod is fixed immovably to said ratcheting mechanism such that rotation of said ratcheting mechanism causes said rod to also rotate.

2. The method as defined in claim 1, wherein the platform further comprises a pair of movable sidewalls.

3. The method as defined in claim 2, wherein said pair of movable sidewalls move inward toward the center of said platform.

4. The method as defined in claim 1, further comprising identifying and recording a degree of the tilt of said platform in terms of degrees relative to a horizontal plane.

5. The method as defined in claim 4, further comprising comparing the tilt degree result to a previous tilt degree result.

6. The method as defined in claim 1, further comprising manually or electronically rotating said ratcheting mechanism.

7. A method for positioning a neck of a human body in a flexion position or an extension position, comprising:

providing a platform that supports said neck;

providing at least a first and a second cylindrical platform sleeve connected at or near one end of said platform and comprising a hole at each end of each of said first and second platform sleeves;

providing a support that supports and is connected to said platform;

providing at least one cylindrical support sleeve connected at or near one end of the support and comprising a hole at each end of each of said at least one cylindrical support sleeve;

providing at least one rod positioned through the first and the second cylindrical platform sleeves and the at least one cylindrical support sleeve, thereby connecting said platform to said support, wherein:

said rod is straight and round and comprises two ends, all of said holes of said first and second platform sleeves and said at least one support sleeve are aligned with each other creating a single straight tunnel through all of said sleeves, said rod is located inside said tunnel, said rod is fixed and is not rotatable with respect to said first and second platform sleeves such that rotation of said rod causes said platform to tilt, said rod is not fixed and is rotatable with respect to said at least one support sleeve, and the rod and the first and second cylindrical platform sleeves and at least one cylindrical support sleeve form a hinge mating the platform to the support;

providing a tilting mechanism comprising a ratchet mechanism that is connected to one of said two ends of the at least one rod, wherein said at least one rod is fixed immovably to said ratcheting mechanism such that rotation of said ratcheting mechanism causes said rod to also rotate;

positioning the human body on the platform, wherein the neck of the human body is resting on and supported by the platform;

positioning a medical imaging device near the neck; and imaging the neck with the medical imaging device, wherein the neck is in the flexion or extension position.

8. The method as defined in claim 7, wherein part or all of said platform contacts the back of the neck of the human body.

9. The method as defined in claim 7, further comprising recording a tilt degree of angulation of the platform with respect to a horizontal plane.

10. The method as defined in claim 9, further comprising comparing the result of said tilt degree to a previous tilt degree result.

11. The method as defined in claim 7, wherein the platform further comprises a pair of movable sidewalls, and further comprising positioning said sidewalls on either side of said neck, thereby precluding movement of the neck.

12. A method for positioning a neck of a human body in a flexion position, comprising:

providing a platform that holds the neck of said human body in a flexion position;

providing at least a first and a second cylindrical platform sleeve connected at or near one end of said platform and comprising a hole at each end of each of said first and second platform sleeve;

providing a support that supports and is connected to said platform;

providing an attachment mechanism to attach the support to the platform, wherein said attachment mechanism comprises the first and the second cylindrical platform sleeves connected to and extending from an end of the platform;

providing at least one cylindrical support sleeve connected to and extending from an end of the support;

providing a rod, positioned through the holes of said first and said second platform sleeves and said at least one cylindrical support sleeve thereby connecting said platform to said support;

wherein:

said rod is straight and round and comprises two ends, all of said holes of said first and said second cylindrical platform sleeves and said at least one support sleeve are aligned with each other creating a single straight tunnel through all of said sleeves, said rod is located inside said tunnel, said rod is fixed and is not rotatable with respect to said first and said second cylindrical platform sleeves such that rotation of said rod causes said platform to tilt, and said rod is not fixed and rotatable with respect to said at least one support sleeve, the rod and the first and second cylindrical platform sleeves and the at least one cylindrical support sleeve form a hinge connecting the platform to the support;

providing a connection that fixedly connects said platform at or near one end of a medical examining table;

providing a tilting mechanism comprising a ratchet mechanism that is connected to one of said two ends of the rod, wherein said rod is fixed immovably to said ratcheting mechanism such that rotation of said ratcheting mechanism causes said rod to also rotate;

positioning the human body on the medical table;

supporting the neck with the platform; and adjusting the ratcheting mechanism such that the neck is in the flexion position.

13. The method as defined in claim 12, wherein the platform further comprises a pair of movable sidewalls.

14. The method as defined in claim 13, wherein said pair of movable sidewalls move inward toward the center of said platform and lock in place.

15. The method as defined in claim 12, further comprising identifying and recording a degree of the tilt of said platform in terms of degrees relative to a horizontal plane.

16. The method as defined in claim 15, further comprising comparing the tilt result to a previous tilt result.

* * * * *